US009799175B2

(12) United States Patent
Stagg

(10) Patent No.: US 9,799,175 B2
(45) Date of Patent: Oct. 24, 2017

(54) SIGNAL DEVICE WITH INDIRECT LIGHTING SIGNAL

(71) Applicant: Bradley Benjamin Stagg, Fort Mills, SC (US)

(72) Inventor: Bradley Benjamin Stagg, Fort Mills, SC (US)

(73) Assignee: White Stagg, LLC, Pineville, NC (US)

( * ) Notice: Subject to any disclaimer, the term of this patent is extended or adjusted under 35 U.S.C. 154(b) by 0 days.

(21) Appl. No.: 14/703,419

(22) Filed: May 4, 2015

(65) Prior Publication Data

US 2015/0339896 A1 Nov. 26, 2015

Related U.S. Application Data

(60) Provisional application No. 61/989,121, filed on May 6, 2014.

(51) Int. Cl.

| | |
|---|---|
| ***G08B 5/36*** | (2006.01) |
| ***G08B 21/14*** | (2006.01) |
| ***G08B 17/10*** | (2006.01) |
| ***G08B 21/10*** | (2006.01) |
| ***G08B 17/113*** | (2006.01) |
| *G08B 1/08* | (2006.01) |
| *G08B 17/00* | (2006.01) |
| *G08B 27/00* | (2006.01) |

(52) U.S. Cl.

CPC ..... *G08B 5/36* (2013.01); *G08B 17/10* (2013.01); *G08B 17/113* (2013.01); *G08B 21/10* (2013.01); *G08B 21/14* (2013.01); *G08B 1/08* (2013.01); *G08B 17/00* (2013.01); *G08B 27/00* (2013.01)

(58) Field of Classification Search

None

See application file for complete search history.

(56) References Cited

U.S. PATENT DOCUMENTS

| | | | | |
|---|---|---|---|---|
| 4,365,237 | A | 12/1982 | Knight | |
| 5,594,422 | A | 1/1997 | Huey, Jr. et al. | |
| 5,898,369 | A | 4/1999 | Godwin | |
| 6,121,885 | A * | 9/2000 | Masone | G08B 17/10 340/286.05 |
| 6,522,248 | B1 | 2/2003 | Gilbert et al. | |
| 6,747,557 | B1 | 6/2004 | Petite et al. | |
| 6,753,786 | B1 | 6/2004 | Apperson et al. | |
| 6,762,688 | B2 | 7/2004 | Johnston et al. | |
| 6,819,252 | B2 | 11/2004 | Johnston et al. | |
| 6,873,254 | B2 | 3/2005 | Andres et al. | |
| 6,897,774 | B2 | 5/2005 | Costa et al. | |
| 6,970,077 | B2 | 11/2005 | Johnson et al. | |
| 7,019,646 | B1 | 3/2006 | Woodard et al. | |
| 7,034,703 | B2 | 4/2006 | Morris | |
| 7,142,105 | B2 | 11/2006 | Chen | |

(Continued)

*Primary Examiner* — Leon-Viet Nguyen

(74) *Attorney, Agent, or Firm* — Seth L. Hudson; Clements Bernard Walker, PLLC

(57) ABSTRACT

The present invention provides methods and systems for a signal device that includes at least one smoke detecting device, optionally a severe weather warning device, and optionally a carbon monoxide detecting device, which are housed within a housing comprising a top portion and a base. A circuit board having a top side and a bottom side that extends to an outer edge is also contained within the housing, and at least one LED is positioned in close proximity to the outer edge of the bottom side of the circuit board.

18 Claims, 6 Drawing Sheets

(56) References Cited

U.S. PATENT DOCUMENTS

| | | | | |
|---|---|---|---|---|
| 7,218,239 | B2 | 5/2007 | Ropke | |
| 7,248,156 | B2 | 7/2007 | Wisniewski et al. | |
| 7,312,714 | B2 | 12/2007 | Morris | |
| 7,327,247 | B2 | 2/2008 | Tice | |
| 7,403,128 | B2 | 7/2008 | Scuka et al. | |
| 7,417,540 | B2 | 8/2008 | Johnston et al. | |
| 7,463,159 | B2 | 12/2008 | Hess et al. | |
| 7,522,063 | B2 | 4/2009 | Ehlers | |
| 7,567,174 | B2 | 7/2009 | Woodard et al. | |
| 7,642,924 | B2 | 1/2010 | Andres et al. | |
| 7,714,700 | B2 | 5/2010 | Morris | |
| 7,714,733 | B2 | 5/2010 | Farley et al. | |
| 7,733,234 | B2 | 6/2010 | Montgomery | |
| 7,755,481 | B2 | 7/2010 | Gayden | |
| 7,782,191 | B2 | 8/2010 | Flores | |
| 7,804,402 | B2 | 9/2010 | Lang et al. | |
| 7,872,573 | B2 | 1/2011 | Lamb | |
| 7,994,928 | B2 | 8/2011 | Richmond | |
| 8,077,046 | B1 | 12/2011 | Wong | |
| 8,232,884 | B2 | 7/2012 | Pattok et al. | |
| 8,451,132 | B1 | 5/2013 | Van Vleet | |
| 8,610,587 | B2 | 12/2013 | Tropper | |
| 2007/0132575 | A1* | 6/2007 | Ellul | G08B 5/38 340/524 |
| 2008/0048873 | A1 | 2/2008 | Araiza-Boys | |
| 2008/0055097 | A1 | 3/2008 | Chidakel et al. | |
| 2009/0302026 | A1* | 12/2009 | Shaw | F24C 7/08 219/489 |
| 2010/0073172 | A1 | 3/2010 | Lax | |
| 2011/0187543 | A1 | 8/2011 | Russo et al. | |
| 2012/0112920 | A1 | 5/2012 | Ramdeo | |
| 2013/0201022 | A1* | 8/2013 | Brigham | G08B 17/107 340/584 |
| 2014/0085093 | A1 | 3/2014 | Mittleman et al. | |

* cited by examiner

SIGNAL DEVICE WITH INDIRECT LIGHTING SIGNAL

CROSS REFERENCE TO RELATED PATENT APPLICATION

The current application claims the benefit of the earlier priority filing date of the provisional application Ser. No. 61/989,121 that was filed on May 6, 2014.

FIELD OF THE INVENTION

The present invention relates generally to a signal device with an indirect lighting signal, and more generally relates to a warning signal device for detecting smoke and/or fire and/or carbon monoxide and/or severe weather and projecting color coded warning signals through indirect light.

BACKGROUND OF THE INVENTION

A smoke detecting device generally comprises, for example, a base secured to a ceiling or the like, a body removably set to the bottom of the base, and an outer cover for covering the face (bottom) opposite to the base of the detecting body.

The detecting body comprises a circuit part comprising a printed circuit board on which electronic parts serving as a fire detecting circuit are mounted, a detecting part serving as a sensor for detecting smoke, and a body to which the circuit part and the detecting part are secured and which is removably set to the base. The detecting device may be based upon either an ionization or photoelectric detection.

In ionization detection, the detecting part has, for example, an inner electrode having a radiation source, an intermediate electrode set so as to face the inner electrode, and an outer electrode (outer chamber) formed so as to cover the opposite side to the inner electrode of the intermediate electrode, in which the gap between the inner electrode and the intermediate electrode is formed as an almost-closed inner ionization chamber and the gap between the intermediate electrode and the outer chamber is formed as an outer ionization chamber allowing smoke to enter from the outside.

An opening is formed on the intermediate electrode so that the radiation emitted from the radiation source provided for the inner electrode can be also irradiated to the outer ionization chamber. The ionization smoke detecting device uses a field effect transistor (hereafter referred to as FET) for detecting a potential change at the joint between the inner and outer ionization chambers and the intermediate electrode is connected to the FET. Because an ionization smoke detecting device has a relatively complicated structure having an inner ionization chamber and an outer ionization chamber as described above, the detecting device has problems that it takes a lot of time to assemble and set the detecting device and it is difficult to decrease the cost.

For example, in the case of the FET, the insulation between terminals may be deteriorated due to humidity or dust. Therefore, it is preferable to use the FET in a closed state. Moreover, it is necessary that an intermediate electrode connected to the FET is set so as to face an inner electrode under an insulated state. Therefore, it is troublesome to set the FET and intermediate electrode.

Photoelectric detection includes a detecting device for detecting an infrared (IR) light source and an IR photodiode receiver positioned at opposite ends of a detection chamber. They are located off axis from each other to prevent the IR light source emitted energy from flowing directly to the receiver. Light absorbing baffles and coatings within the chamber are used to attenuate all quiescent state IR reflections, to provide a controlled, minimum value of photodiode current in the non-smoke state. In the event of a fire, combustion particles entering the device's chamber disturb the quiescent state absorption characteristics, thereby producing IR scattering and causing IR energy to be detected by the photodiode. The photodiode responds by providing an output electrical current at a magnitude proportional to the detected IR, and when the current exceeds a selected threshold the device sounds the alarm. Existing types of carbon monoxide detecting devices can be broadly classified into one of four types according to the gas sensitive element employed: chemical, electrochemical, semiconducting or spectroscopic (infra-red). The electrochemical and spectroscopic devices, whilst offering rapid response times, high resolution and high accuracy, are expensive and not suitable for domestic use. Chemical sensors are inexpensive devices that are usually based on palladium or iodine salts which exhibit a color change upon exposure to CO. They are of two classes; tapes for continuous monitoring which can provide very fast and sensitive response (typically sub ppm concentrations are sensed) but these require very careful control over moisture content and tubes which are used for spot checks and are of generally lower sensitivity than tapes although they do not require such careful control of moisture. Both types rely on a color change and could not be made "automatic" by the application of an electronic device the degree of color change. These devices are not reusable. However, their response to low CO concentrations tends to be poor and therefore constant monitoring is required and can only be used once and fail to provide audible warning signals.

The most popular carbon monoxide detecting devices for domestic use utilize a gas sensitive semiconductor; the resistance of which changes upon exposure to a reducing gas. Of these the most popular material is $SnO_2$ and platinum doped $SnO_2$ other binary oxides include ZnO, TiO2 and a combination of CuO and ZnO to form a heterocontact. More recently the use of mixed metal oxide semiconductors for CO detection has been reported. These materials include the niobates $CrNbO_4$, $FeNbO_4$ and $Ba_6Fe_{1.5}Nb_{8.5}O_{30}$ and the perovskite $La_{0.5}Sr_{0.5}C0_3$.

Weather radio receivers for use with the National Oceanic and Atmospheric Administration Weather Radio (NWR) service are widely available and incorporate various features according to cost and manufacturer. The most basic receiver feature consists of providing an emergency alert notification in response to a NWR broadcast describing an event that threatens life or property.

The National Weather Service (NWS) uses an NWR-Specific Area Message Encoding (NWR-SAME) scheme. By placing encoded information at the beginning and end of each emergency broadcast, the NWR-SAME scheme permits greater control of transmitters, receivers, and other broadcasting equipment within a specific geographic region. The encoded information is transmitted on NWR radio channels using audio frequency shift keying (AFSK) and contains information describing the emergency and the NWR-SAME emergency alert broadcast. Aspects of this information may include, for example, the emergency type, the geographic area affected, the expected duration of time for which the information contained in the emergency alert broadcast is valid, the date and time of the broadcast, and the identity of the broadcast originator. A weather radio receiver capable of interpreting this information may be programmed to provide an emergency alert notification in response to receiving a NWR-SAME broadcast only if user-defined emergency alert preferences such as, for example, the emergency type and the geographic area affected, are satisfied.

BRIEF SUMMARY OF THE INVENTION

According to an embodiment of the present invention, the signal device includes at least one smoke detecting device, optionally a severe weather warning device, and optionally a carbon monoxide detecting device, which are housed within a housing comprising a top portion and a base. A circuit board having a top side and a bottom side that extends to an outer edge is also contained within the housing, and at least one LED is positioned in close proximity to the outer edge of the bottom side of the circuit board.

According to another embodiment of the present invention, the signal device includes a plurality of LEDs that are in a spaced-apart relationship and in close proximity to the outer edge of the bottom side of the circuit board.

According to yet another embodiment of the present invention, the signal device includes a plurality of LEDs that are in a spaced-apart relationship around the rim of the top portion of the circuit board with at least two different colors and each color being illuminated based upon a predetermined condition.

According to yet another embodiment of the present invention, the signal device includes a light source that is an RGB LED.

According to yet another embodiment of the present invention, the signal device includes a smoke detecting device that is selected from the group consisting of an ionized particle smoke detecting device and a photoelectric smoke detecting device.

According to yet another embodiment of the present invention, the signal device includes an antenna disposed on the bottom side of the circuit board.

According to yet another embodiment of the present invention, the signal device includes a speaker for transmitting an audio warning signal.

According to yet another embodiment of the present invention, the signal device includes a rechargeable battery.

According to yet another embodiment of the present invention, the signal device includes at least two smoke detecting devices, optionally a severe weather warning device, and optionally a carbon monoxide detecting device. The signal device includes a housing comprising a base and a top portion, a circuit board having a top side and a bottom side that extend to an outer edge, and the circuit board is contained within the housing. At least one LED is positioned in close proximity of the outer edge of the bottom side of the circuit board.

According to yet another embodiment of the present invention, the signal device includes a plurality of LEDs in a spaced-apart relationship around the rim of the top portion with at least two different colors and each color being illuminated based upon a predetermined condition.

According to yet another embodiment of the present invention, the signal device includes air gaps spaced around the periphery of the base.

According to yet another embodiment of the present invention, the signal device includes air gaps spaced around the periphery of the base and a rib extending inward from a side of each air gap.

According to yet another embodiment of the present invention, the signal device includes a mounting bracket for receiving the base, whereby the LED is positioned such that light from the LED shines on the mounting bracket.

According to yet another embodiment of the present invention, the signal device includes illumination of the LED when the smoke detecting device, carbon monoxide detecting device, or the severe weather warning detecting device detects a triggering event such as smoke, severe weather, or carbon monoxide.

According to yet another embodiment of the present invention, the signal device includes at least two smoke detecting devices, a severe weather warning device, and a carbon monoxide detecting device. A housing includes a base and a top portion, and a circuit board having a top side and a bottom side that extend to an outer edge that is contained within the housing. A plurality of LEDs are positioned in close proximity of the outer edge of the bottom side of the circuit board.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
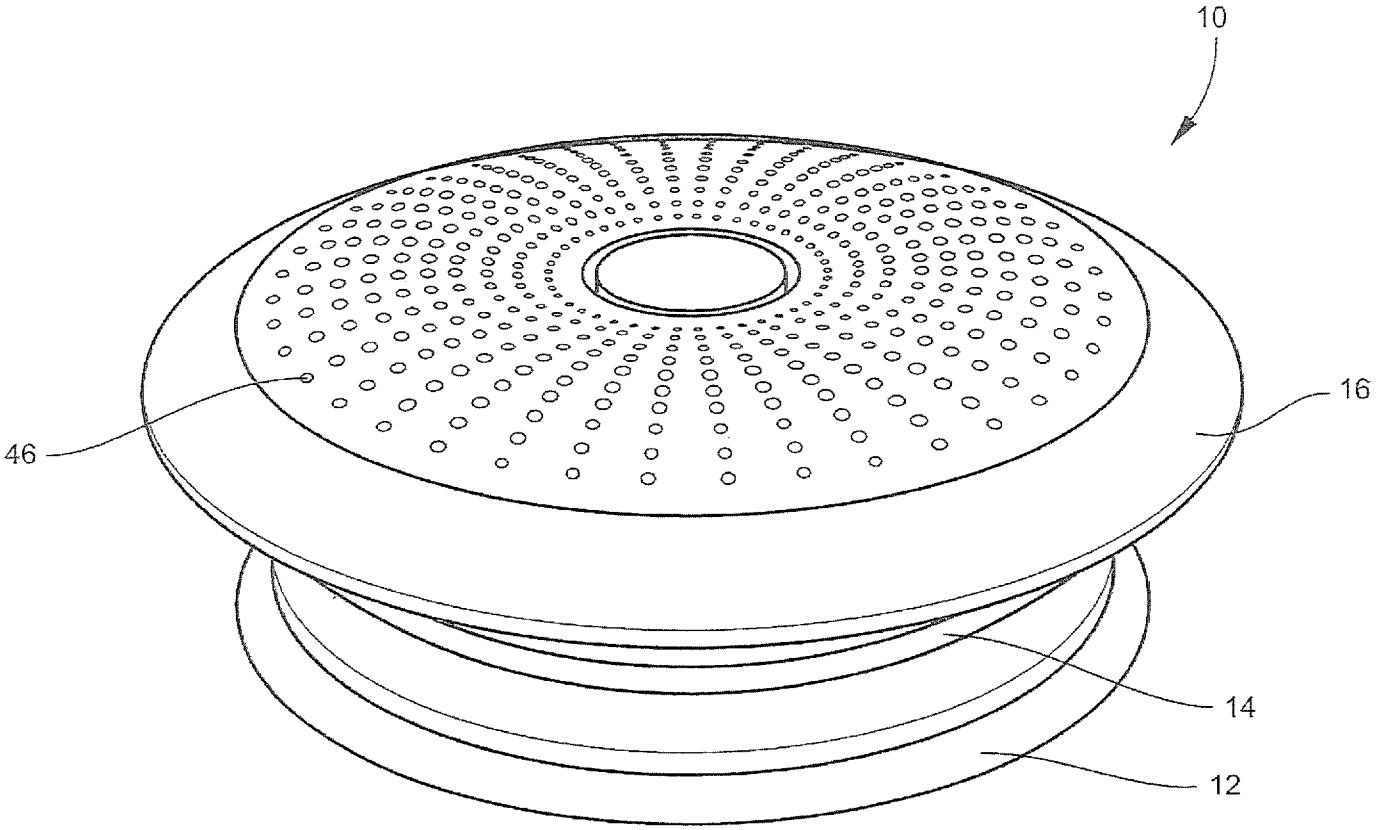
FIG. 1 is a perspective view of the signal device.

Referring now specifically to the drawings, a signal device is illustrated in FIG. 1 and is shown generally at reference numeral 10. The signal device 10 includes a mounting plate 12 with top and bottom mating features and a housing 13. The housing includes a base 14 and a top portion 16. The base 14 is engaged to the mounting plate 12 with corresponding mating features to provide a selectively secured arrangement with the bottom mating features of the mounting plate 12. The top portion 16 is selectively secured to the base 14 and having at least one air gap 18 provided on the periphery or side of the base 14 to allow air to flow through the unit for detection of smoke and/or carbon monoxide (CO). The signal device 10 may also include a smoke chamber or carbon monoxide chamber secured within a cavity formed between the base 14 and top portion 16.

The mounting plate 12 is generally circular and has a top side and a bottom side. The top mating features are disposed on the top side and designed to assist with mounting the signal device 10 to a ceiling, wall, or the like. The bottom mating features are disposed on the bottom side of the mounting plate 12 for mounting to corresponding mating features on the first side of the base 14. The engagement of the mating features is a selectively secured arrangement for allowing the base 14 to be separated from the mounting plate 12.

The top portion 16 is selectively secured to the base 14. As illustrated, the top portion 16 has at least two resiliently flexible fingers that extend downwardly from the top portion 16 for being received within a corresponding receptacle in the base 14 for forming a selectively secured arrangement. The diameter of the top portion 16 may be larger than the diameter of the base 14. A plurality of air gaps 18 are disposed around the periphery or side of the base 14. The air gap 18 consists of an opening within the side of the base 14, including at least one side and as illustrated the air gap 18 has four sides, and includes an angular rib 20 extending within the base 14. The air gaps 18 completely surround the base 14 allowing air to penetrate any side of the base 14. The angular rib 20 directs air into the interior of the base 14. Preferably, the base 14 is composed of a translucent or transparent material.

The housing 13 includes a smoke detecting device and/or fire detecting device and/or carbon monoxide detecting device, which activates an alarm when smoke and/or fire and//or carbon monoxide is detected. The phrase smoke and/or fire detecting device will be termed a smoke detecting device. The smoke detecting device may be an ionized particle detecting device for detecting smoke, a photoelectric smoke detecting device, a heat sensing device serving as a fire detecting device, or a combination of smoke and fire detecting instruments or devices, as desired. The detecting device may be a chemical, electrochemical, semiconducting, or spectroscopic carbon monoxide detecting device. The alarm is preferably an economical piezoelectric unit serving to emit a single audible tone.

Figure 2:
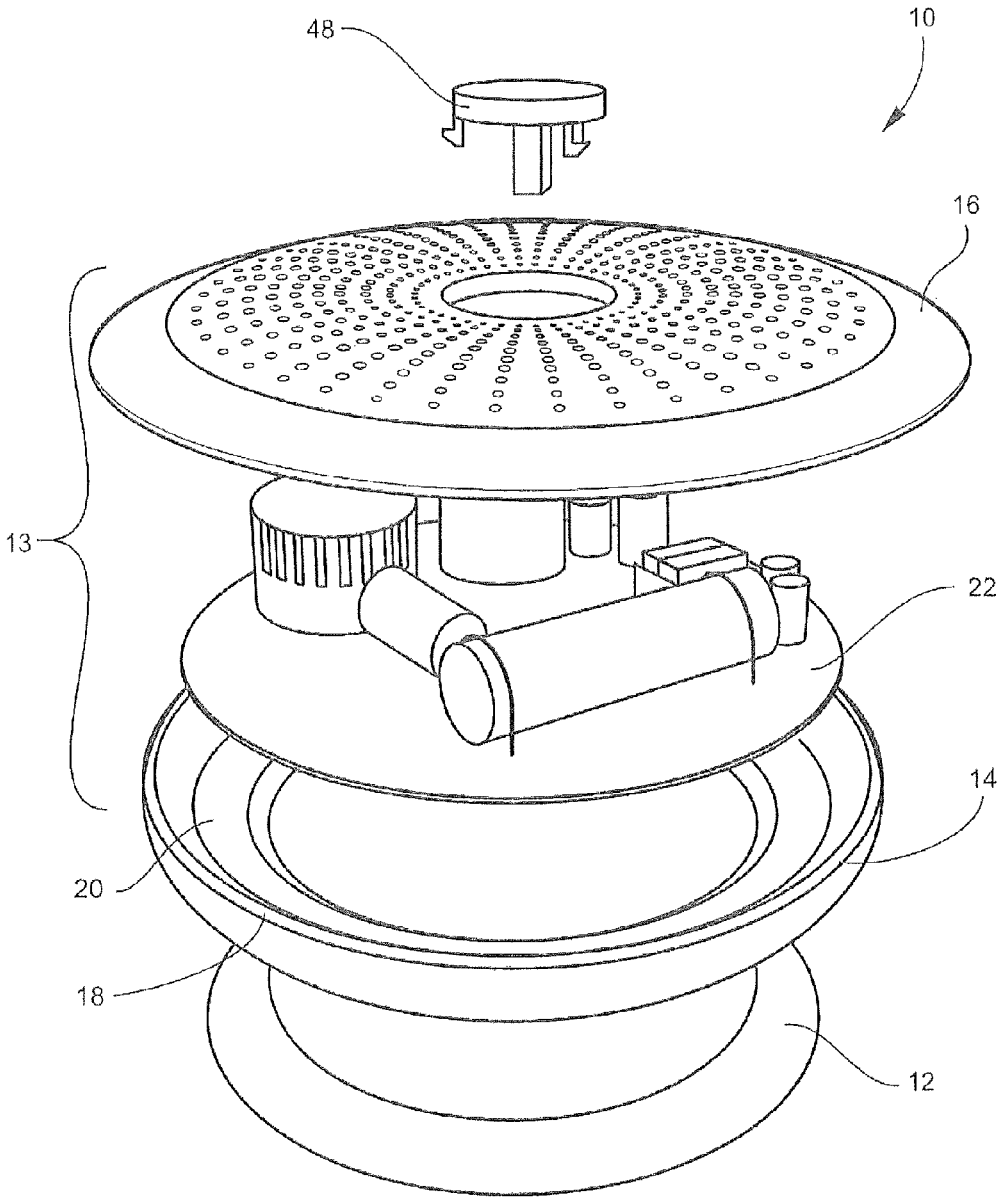
FIG. 2 is an exploded view of the signal device.
Figure 3:
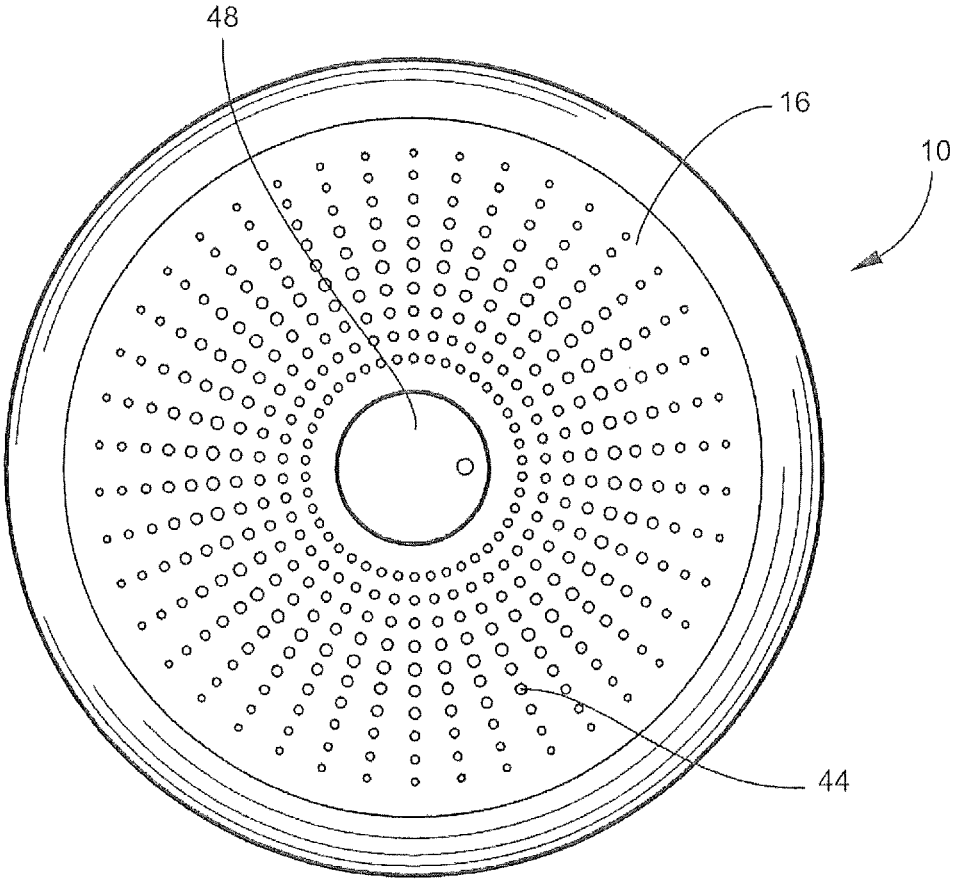
FIG. 3 is a top view of the signal device diagram for the warning system.
Figure 4:
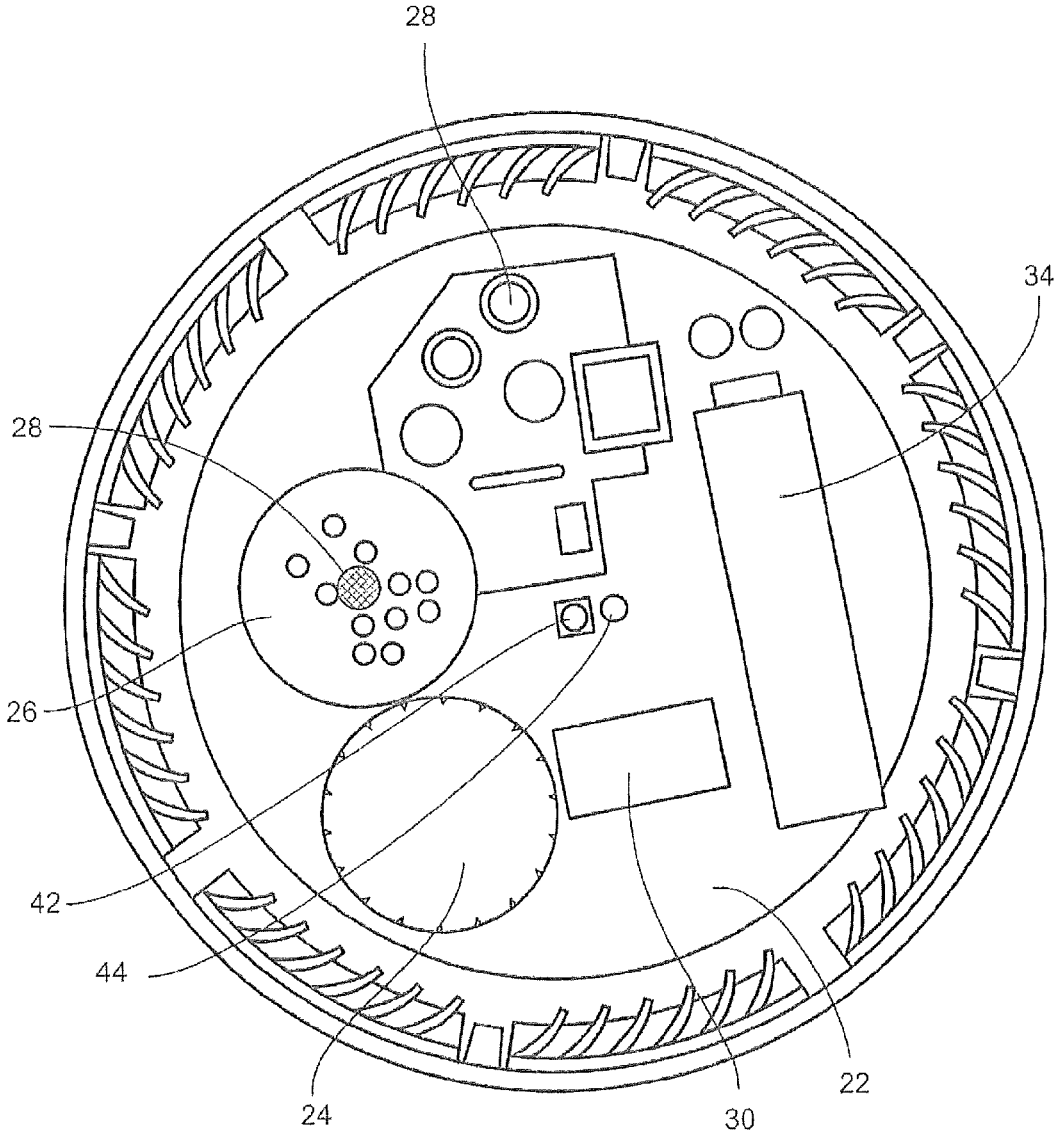
FIG. 4 is a top view of the circuit board.

As illustrated in FIG. 2, a circuit board 22 is housed within the housing 13. Preferably, the circuit board 22 is positioned within the base 14 and surrounded by the air gaps 18 for allowing air to flow over the circuit board 22. The smoke detecting devices (24, 26) are disposed on the top side of the circuit board 22, as shown in FIG. 4. The circuit board may consist of an ionized particle smoke detecting device 24 and a photoelectric smoke detecting device 26. As illustrated these smoke detecting devices (24, 26) are positioned adjacent one another. A speaker 28 is engaged to the top portion of the photoelectric smoke detecting device 26. A carbon monoxide detecting device 30 is positioned on the top side of the circuit board 22. The carbon monoxide detecting device 30 is positioned adjacent a smoke detecting device (24, 26). The carbon monoxide detecting device 30 is in close proximity to the air gaps 18 for detecting the presence of carbon monoxide within the air passing through the air gaps 18.

The detecting devices (24, 26, 30) receive continuous electrical power from a power supply, also enclosed within the housing 13. The power supply 28 in turn receives electrical power from a conventional external electrical power source, which provides nominal 120 volt alternating electrical current for the power supply, which reduces the voltage and rectifies the current to provide a relatively lower voltage direct current supply. An alternative power supply comprising a backup electrical cell or battery 34 is also provided, with the system automatically switching from the external power source to the backup battery in the event of an external power interruption. A low battery power warning means, e.g., an intermittent audible and/or visual warning, may be provided to alert a user that the backup battery is in need of replacement. It will be seen that a rechargeable electrical cell or battery may be provided, with additional circuitry provided for maintaining the electrical charge of the battery so long as external electrical power is supplied. The bottom side of the circuit board 22 contains an AC connector 36, which is a pronged connector, for hardwiring the device 10 to the electrical circuitry.

The bottom side of the circuit board 22 contains a radio receiver 38 integrally connected to an antenna 40. The receiver is an FM device receiving a selected one of several VHF frequencies used for transmitting severe weather warnings and other weather information by NOAA (National Oceanic and Atmospheric Administration). The receiver may include an internal antenna 40, as illustrated, but may also include provision for an external antenna to be connected thereto, from the exterior of the housing 13. The power supply 28 also provides electrical power of proper voltage and polarity to a radio receiver (an on/off switch may be provided between the power supply and receiver, if desired).

The NOAA weather broadcast system uses several channels or frequencies in the 162 mHz range for providing weather information throughout the U.S., to provide line of sight reception capability for receivers tuned to the appropriate frequency or frequencies. Range is generally on the order of fifty miles, depending upon terrain. The appropriate channel or frequency for providing the best reception in a given area, is selected by means of a programming keypad, which may be integrated with the receiver 38 and housing 13. Alternatively, a remote external keypad may be used, which communicates with the receiver by means of rf, infrared, or other electromagnetic frequencies, ultrasonic frequencies, or a hard wired cable, may be used. The keypads serve to select the desired receiving frequency, which is displayed on a programming display (LED or light emitting diode, LCD or liquid crystal display, or other means for indicating the frequency or channel selected) visible at the housing 13.

The NOAA system uses a system called SAME (Specific Area Message Encoding), which encodes each broadcast to cover only a certain applicable area. Radio receivers which have been programmed to receive a different SAME code will not receive a given SAME code, even if those other receivers are within reception range of the broadcast. The programming codes are known as FIPS, or Federal Information Processing System, codes. The FIPS codes are generally ordered on a county wide basis within each state, but larger counties, or areas where relatively localized weather phenomena occur from time to time, can be broken down into smaller areas. The area covered by each specific FIPS coded broadcast, and the areas relevant to each specific FIPS code, are determined by NOAA.

Accordingly, the present combination smoke detecting device and severe weather warning device invention includes means for setting the FIPS code for the receiver, as by use of the programming keypad or remote keypad which is also used to select the appropriate frequency of the receiver. The FIPS code being entered is displayed in the programming display, just as the selected frequency which was entered, was displayed. It should be noted that this display, and any other display provided with the present invention, may be backlighted for legibility in darkness, if so desired, with electrical power for the display lighting being provided by the common power supply 28.

When a weather broadcast incorporating the selected FIPS code is received by the receiver, creating a trigger event, the message is output to appropriate means, depending upon the nature of the broadcast received. In the event of a severe weather warning (severe thunderstorms in the immediate area, tornado sightings in the immediate area, etc.) an alarm signal is broadcast before the actual voice weather message. A speaker integrated within the housing 13 transmits this audible alarm to users of the present device. A volume control and/or mute control may be incorporated for a user to adjust the volume as desired, depending upon the distance from the device and its speaker.

The NOAA severe weather radio system provides for more than only severe weather broadcasts. The system also provides for dissemination of weather watches (e.g., severe thunderstorms and/or tornadoes forecast for a given area, etc.) and general weather broadcasts for a given area, as well. Each of these different types of weather information (weather warnings, weather watches, and broadcast statements of the weather reported or forecast for the area) is accompanied by a specific signal, using the SAME technology. Accordingly, each specific signal may be used to activate a specific type of annunciator to alert a user as to the specific type of weather information being received. For example, a red light could be activated to indicate a severe weather warning broadcast being received, a yellow or amber light for a weather warning, and a green light for general weather information or statements. Such lights could be incorporated in a weather warning/weather watch/message alert area of the housing 13.

The top side of the circuit board 22 may also contain a test button 42. The test button 42, when depressed causes an alarm to sound or other noise to be emitted from the speaker 28 on the device 10 to indicate it is working properly. A light 44 is also disposed on the top side of the circuit board 22 for indicating power is being supplied to the device 10. When the light is "on" or lit, power is being supplied to the device 10. When the light is "off" or not lit, no power is being supplied to the device 10.

Figure 5:
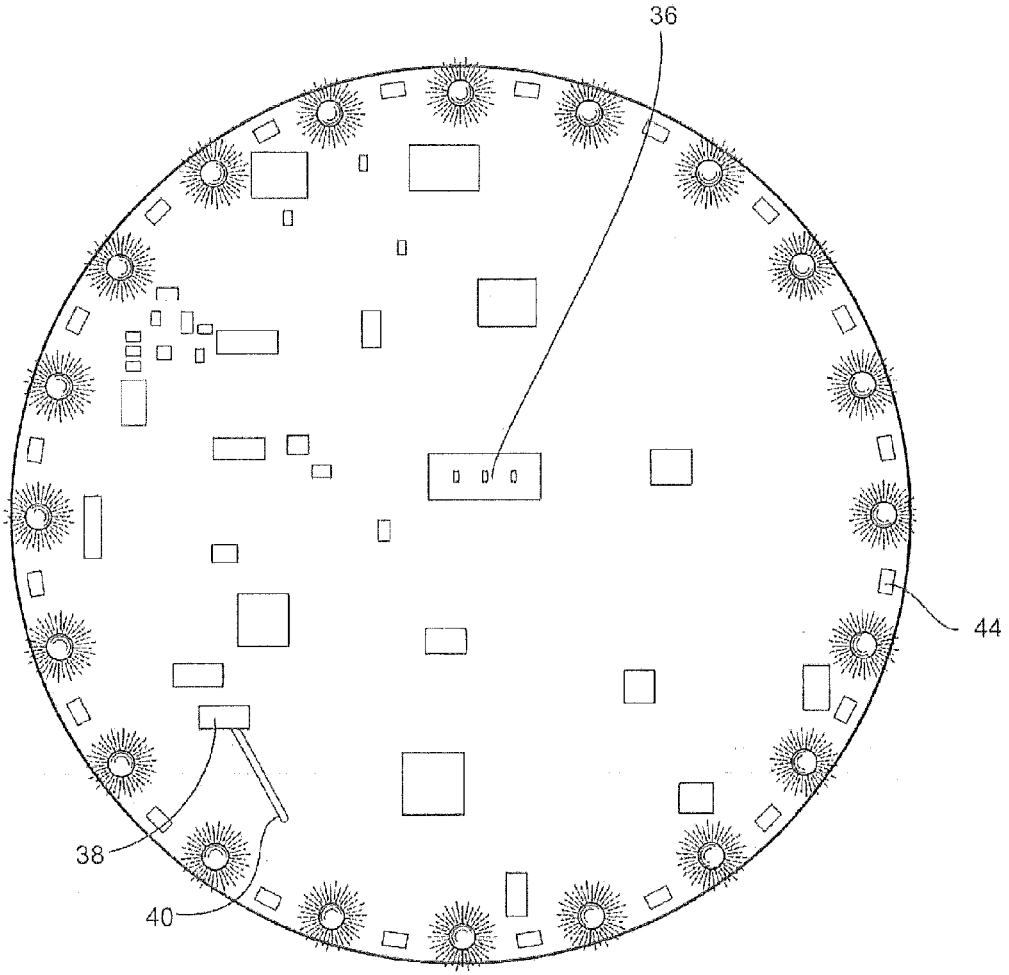
FIG. 5 is a bottom view of the circuit board.
Figure 6:
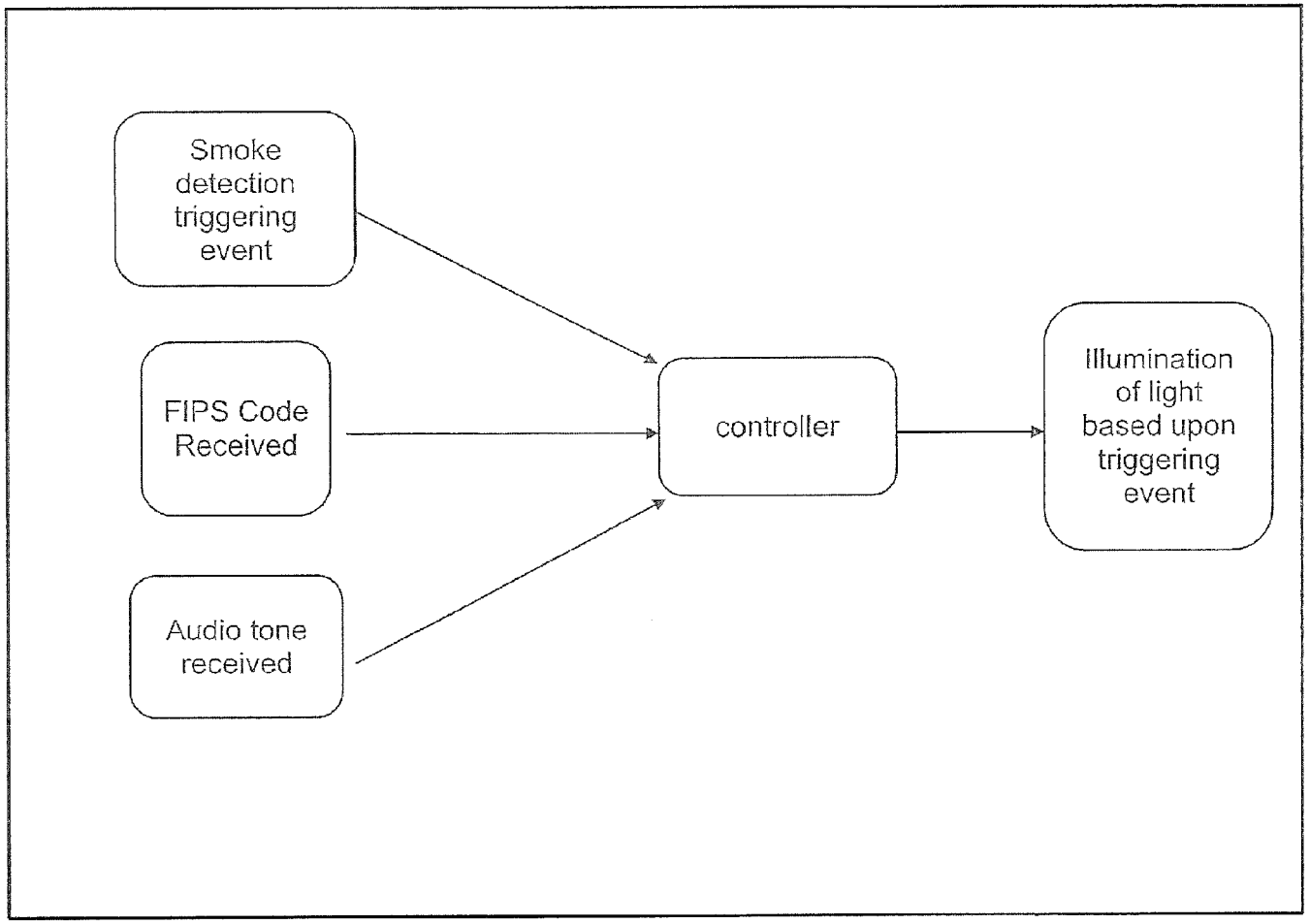
FIG. 6 is a flow diagram indicating the triggering event of the signal device.

At least one LED 44 is disposed on the outer edge of the bottom side of the circuit board 22. As illustrated in FIG. 5, a plurality of LEDs 44 are positioned around the outer edge of the bottom side of the circuit board 22. When the detecting device is activated by the detection of smoke or carbon monoxide creating a triggering event, a signal is transmitted to the at least one LED 44 for the activation of the LED 44, as illustrated in FIG. 6. When a weather broadcast incorporating the selected FIPS code is received by the receiver, creating a triggering event, a signal is transmitted to the at least one LED 44 for the activation of the LED 44. The signal transmitted turns the LED 44 to the "on" position and illuminates the LED 44 that projects the light towards the base 14.

As illustrated in FIG. 5, the plurality of LEDs 44 are disposed in a spaced-apart relationship around the outer edge of the bottom side of the circuit board 22. The LEDs 44 arranged in this embodiment create an indirect light that shines of the ceiling, wall, or the like when the device 10 is attached. For example, when the device 10 is attached to a ceiling, the light from the LEDs 44 shine onto the ceiling in a circular pattern and creating a "halo" effect. By way of this arrangement, at least a minimum amount of the light can shine through the base 14 of the device 10. The LEDs 44 are strategically aligned with the air gaps 18 in the base 14 for allowing the light from the illuminated LEDs 44 to shine through the air gaps 18 and onto the base 14 and the ceiling, wall, or the like when the device 10 is attached. The translucent or transparent base 14 also allows the light from the LEDs 44 to pass through the base and onto the ceiling, wall, or the like when the device 10 is attached.

As shown in FIG. 6, the detection of smoke or carbon monoxide by a smoke detecting device (24, 26) or the carbon monoxide detecting device (30) creates a triggering event. A weather broadcast incorporating the selected FIPS code is received by the receiver 38, creating a triggering event. Alternatively, an audio tone detected from the weather broadcast creates a triggering event. Once the triggering event occurs, a signal is sent to a controller that activates the LED 44 based upon the triggering event. Additionally, an audible sound is emitted from the speaker 28, indicating the detection and presence of smoke and/or carbon monoxide.

In an alternative embodiment, the device 10 may contain an LED 44 that is able to project different colors or multiple LEDs 44 that project different colors. The signal transferred after the triggering event will activate a single color to be associated with the triggering event. By way of example only, an RGB LED may be utilized that would allow for the red light to be illuminated at one triggering event, the green light illuminated at a different triggering, and the blue light illuminated at a different triggering. In one embodiment, the red light may be illuminated when a smoke or carbon monoxide is detected by the detecting device, illustrating the device 10 has detected smoke and/or a fire. This illumination of the red light may be associated with an alarm indicating the detection of smoke or carbon monoxide. The green light may be illuminated when a weather broadcast is received to warn the user of severe weather. This illumination of the green light may be associated with an alarm or audio signal warning of the severe weather. The blue light may be illuminated as an "all clear" signal. For instance, the blue light may be illuminated for a predetermined period of time after the detecting device last detects smoke. Alternatively, the blue light may be illuminated for a predetermined period of time after the severe weather alert has been cancelled. In another alternative embodiment, the blue light may indicate a detection of carbon monoxide and read indicate the detection of smoke.

As illustrated in FIG. 1, the top portion 16 may contain a plurality of holes 46. The holes 46 allow air to penetrate the device 10 and flow across the circuit board 22 for the detection of smoke by the smoke detecting device (24, 26) or the carbon monoxide detecting device 30. Additionally, the holes 46 allow the sound waves produced from the speaker 28 to be transmitted through the holes 46. A push button 48 is disposed on the top portion 16 of the device 10. The push button 48 is disposed within the central area of the top portion 16 and contains a perpendicularly extending rod. The rod contacts the test button 42. Then the push button 48 is depressed, it contacts and depresses the test button 42, indicating to the user whether the device 10 is operating.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A signal device, comprising:

at least one smoke detecting device;

a mounting plate;

optionally a severe weather warning device;

a carbon monoxide detecting device;

a housing comprising a base and a top portion, the top portion is selectively secured to the base and is positioned over top of the base, wherein the base has periphery and a plurality of air gaps are arranged around the periphery of the base and the base is engaged to the mounting plate and is positioned over top the mounting plate and composed of translucent material;

a circuit board having a top side and a bottom side that extend to an outer edge, and the circuit board is contained within the housing between the base and the top portion; and a plurality of light emitting diodes (LED) are positioned on the circuit board and aligned with the air gaps of the base and in close proximity of the outer edge of the bottom side of the circuit board and directed towards the base of the housing.

2. The device according to claim 1, wherein the plurality of light emitting diodes (LEDs) are in a spaced-apart relationship around the rim of the top side of the circuit board with at least two different colors and each color being illuminated based upon a predetermined condition.

3. The device according to claim 2, wherein a light source on the bottom side of the circuit board is an RGB light emitting diode (LED).

4. The device according to claim 1, wherein the smoke detecting device is selected from the group consisting of an ionized particle smoke detecting device and a photoelectric smoke detecting device.

5. The device according to claim 1, including an antenna disposed ion the bottom side of the circuit board.

6. The device according to claim 1, including a speaker for transmitting a warning signal.

7. The device according to claim 1, including a rechargeable battery.

8. A signal device, comprising:

at least two smoke detecting devices;

a mounting plate;

optionally a severe weather warning device;

a carbon monoxide detecting device;

a housing comprising a base and a top portion, the base and top portion are engaged to each other and the top portion is position above the base, wherein the base is selectively secured to the mounting plate and is positioned above the mounting plate and contains air gaps with angular ribs and composed of translucent material;

a circuit board having a top side and a bottom side that extend to an outer edge, and the circuit board is contained within the housing between the base and the top portion; and at plurality of light emitting diodes (LED) are positioned in close proximity of the outer edge of the bottom side of the circuit board and directed towards the base of the housing.

9. The device according to claim 8, wherein the plurality of light emitting diodes (LEDs) are in a spaced-apart relationship in close proximity to an edge of the bottom side of the circuit board with at least two different colors and each color being illuminated based upon a predetermined condition.

10. The device according to claim 8, further including air gaps spaced around the periphery of the base.

11. The device according to claim 8, further including air gaps spaced around the periphery of the base with at least one side and a rib extending inward from at least one side of each air gap.

12. The device according to claim 8, further including a mounting bracket for receiving the base, whereby the light emitting diodes (LED) are positioned such that light from the light emitting diode (LED) shines on the mounting bracket.

13. The device according to claim 8, further including the illumination of the light emitting diodes (LED) when the smoke detecting device, the severe weather warning device, or the carbon monoxide detecting device detect a triggering event such as smoke, severe weather, or carbon monoxide.

14. The device according to claim 8, further including a rechargeable battery.

15. A signal device, comprising:

at least two smoke detecting devices;

a severe weather warning device;

a carbon monoxide detecting device;

a mounting plate;

a housing comprising a base and a top portion, the base is selectively secured to the top portion and positioned adjacent the top portion forming a cavity within, wherein the base is selectively secured to the mounting plate and positioned adjacent the mounting plate and composed of translucent material;

a circuit board having a top side and a bottom side that extend to an outer edge, and the circuit board is contained within the housing between the base and the top portion; and a plurality of light emitting diodes (LEDs) positioned on the circuit board in close proximity of the outer edge of the bottom side of the circuit board and directed towards the base of the housing.

16. The signal device according to claim 15, further comprising a rechargeable battery.

17. The signal device according to claim 15, further comprising air gaps in the periphery of the base and surrounding the circuit board.

18. The signal device according to claim 15, wherein the light emitting diode (LED) is an RGB light emitting diode (LED).

* * * * *